United States Patent [19]

Frischmann et al.

[11] 4,169,601

[45] Oct. 2, 1979

[54] SOUND BINGO

[76] Inventors: Richard D. Frischmann, c/o George Spector, 3615 Woolworth Bldg., 233 Broadway; George Spector, 3615 Woolworth Bldg., 233 Broadway, both of New York, N.Y. 10007

[21] Appl. No.: 774,907

[22] Filed: Mar. 7, 1977

[51] Int. Cl.[2] ..... A63F 3/06

[52] U.S. Cl. ..... 273/269

[58] Field of Search ..... 273/269, 271, 237

[56] References Cited

U.S. PATENT DOCUMENTS

| | | | |
|---|---|---|---|
| 2,417,537 | 3/1947 | Wyckoff | 273/237 |
| 3,495,700 | 2/1970 | Chandos | 273/269 X |
| 3,633,914 | 1/1972 | Solomon | 273/269 |
| 4,015,850 | 4/1977 | Russell | 273/269 |

FOREIGN PATENT DOCUMENTS

| | | | |
|---|---|---|---|
| 491948 | 4/1953 | Canada | 273/269 |
| 521784 | 3/1921 | France | 273/269 |
| 931901 | 11/1947 | France | 273/249 |
| 94034 | 4/1922 | Switzerland | 273/269 |

OTHER PUBLICATIONS

*The Washington Daily News* Article; Oct. 2, 1940, p. 19, by Ernie Pyle.

*Primary Examiner*—Richard C. Pinkham
*Assistant Examiner*—R. Carl Moy

[57] ABSTRACT

A new type of Bingo game in which each player's card shows pictures of all kinds of sound producing devices or objects and which are covered by the player with a disc or chip in response to a sound played on a phonograph record, and which sound is characteristic of a particular item pictured on the card; the game including cards, discs, and phonograph records.

2 Claims, 5 Drawing Figures

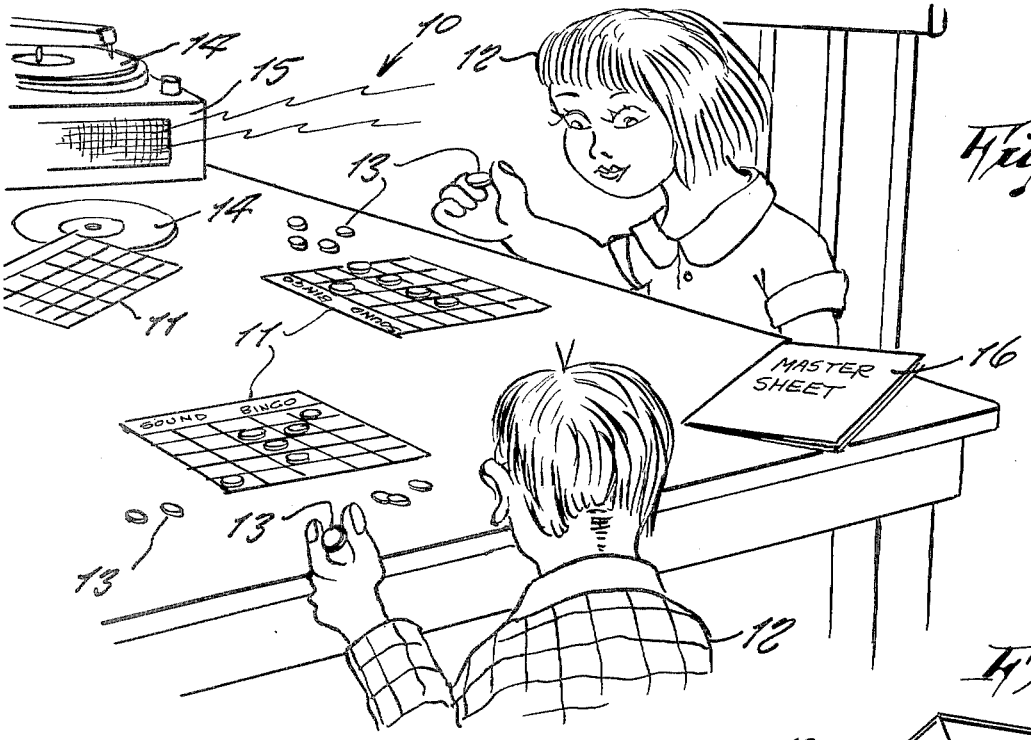
Fig. 1
Fig. 2
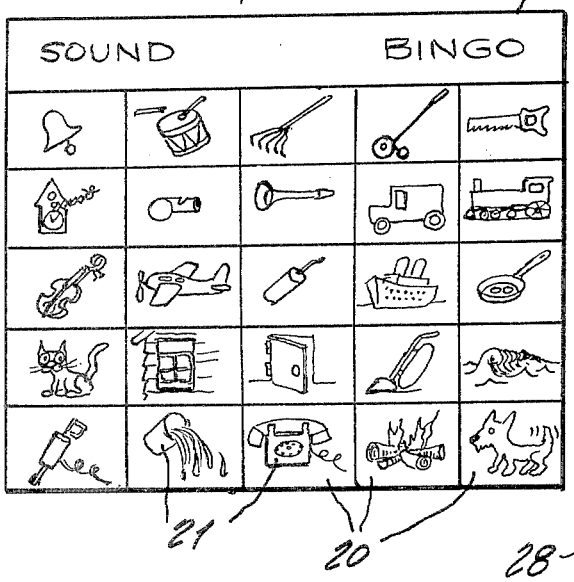
Fig. 3
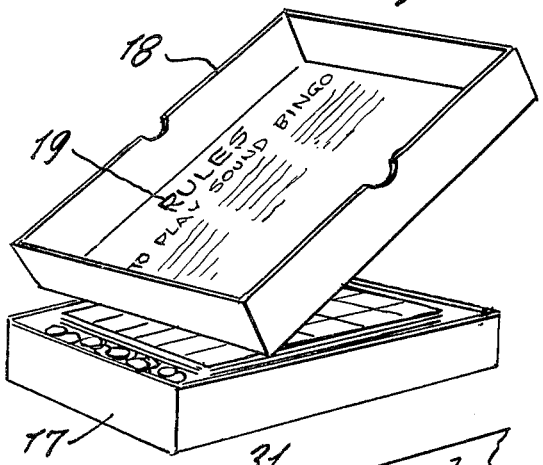
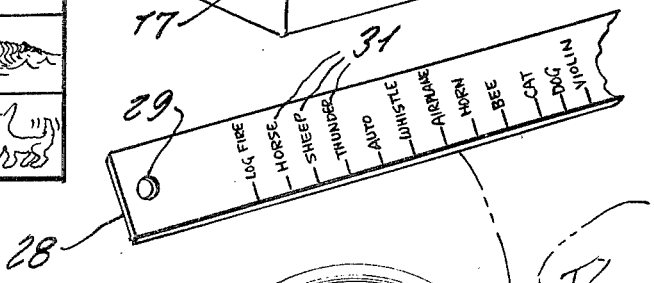
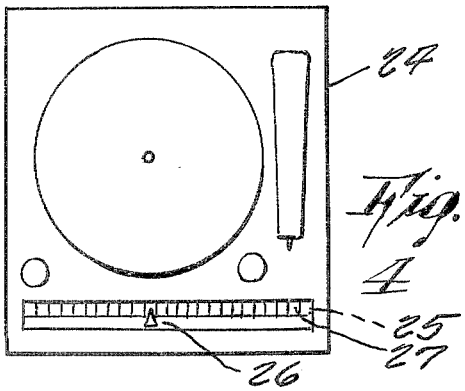
Fig. 4
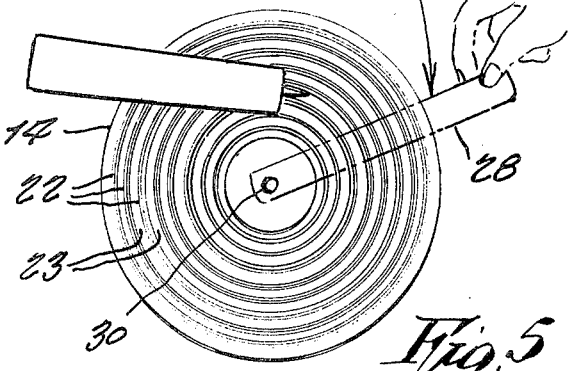
Fig. 5

SOUND BINGO

This invention relates generally to Bingo games.

A principal object of the present invention is to provide a new kind of Bingo game which, instead of using a person calling out numbers to the participating players, utilizes a phonograph playing a record on which all types of sounds are played in sequence, and the participating players place covering discs over pictures on their cards which illustrates objects that produce such sounds.

Another object accordingly is to provide a sound Bingo which is novel so to be fresh and different from the old, conventional game of Bingo.

Yet another object is to provide a sound Bingo which will be particularly educational to small children to identify sounds and sounding objects.

Yet a further object is to provide a sound Bingo which will appeal to all ages, children, and adults.

Other objects are to provide a sound bingo which is simple in design, inexpensive to manufacture, rugged in construction, easy to use and efficient in operation.

These and other objects will be readily evident upon a study of the following specification and the accompanyint drawing wherein:

FIG. 1 is a view of the present invention shown in use.

FIG. 2 is a view of the front side of one of the bingo boards.

FIG. 3 is a view of the game in a box having playing instructions on the underside of the box cover.

FIG. 4 shows one design whereby played sounds can be rechecked, and which includes an arrow driven by the phonograph to travel along a scale calibrated with the names of the different sounds printed thereon, the calibrated scale corresponding with a specific record so that it is interchangeably mounted on the phonograph case.

FIG. 5 shows another design for rechecking sounds that were already played, and consists simply of a calibrated bar having a hole at one end for fitting on the phonograph spindle, the bar calibrations identified by sound name matching the phonograph record groove so to easily recognize all sounds played up to where the needle rests on the record groove; each record having one such calibrated bar.

Referring now to the drawing in greater detail, and more particularly to FIGS. 1 to 3 thereof at this time, the reference numeral 10 represents a game of sound Bingo according to the present invention wherein the same includes a set of playing cards 11 for being used by players 12, a quantity of discs or chips 13 for placing on the cards and a set of phonograph records 14 for being played upon a record player 15. The present invention also includes a set of master sheets 16 used in checking the cards for correctness of answers played.

All the components fit into a box 17 having a removable cover 18 that has the rules of the game printed on the inner side as shown at 19.

Each card 11 is divided into horizontal and vertical rows of five spaces each so to total 25 spaces. Each space 20 has a picture 21 illustrated therein showing a different kind of objects may comprise either mechanical devices such as a bell, a lawnmower, or a vacuum cleaner, or they may comprise either animals such as a dog, cat, cow, lion, or the like, or they may comprise objects in nature that produce sounds such as a thunder, pouring water, ocean waves, a crackling log fire, falling raindrops, and the like.

Each phonograph record 14 is recorded with different sounds of objects that appear on some of the cards; it being understood that each card has a different assortment of sound producing objects illustrated thereupon. These sounds are recorded in sequence so to produce a series of sound producting bands 22 along a single spiral groove on the record. Spaces 23 between the bands serve to provide time between sounds being heard so that players can check their cards during this time to see if the object that produced a sound is illustrated on the player's card. If it is shown, the player covers the space with a disc.

Similarly to conventional Bingo, a first player who covers a horizontal, vertical or diagonal row of five spaces, wins the game.

In FIGS. 4 and 5 a means is shown for checking a winner's card for correctness.

In FIG. 4, a phonograph 24 shows a row of spaces 25 across which a needle 26 travels as a record plays, the needle being moved by the phonograph mechanism. A calibrated scale 27 is placed over the row of spaces 25, the scale being imprinted with the sounds or else the sounding objects, being printed in a same sequence as the sounds appear on a specific record so that the scale is associated with a particular record only. To check a winner's card, the needle identifies what sounds have been already played before a game is stopped by the winner.

In FIG. 5, another checking device 28 comprises simply a stiff cardboard strip having a hole 29 near one end for inserting on the phonograph spindle 30. The strip is imprinted with names of sounds 31 and which align with the corresponding bands 22, so that a person can tell by where a needle is stopped on a record, which sounds have already been played.

While various changes may be made in the detail construction, it is understood that such changes will be within the spirit and scope of the present invention, as is defined by the appended claims.

What is claimed is:

1. A sound bingo game comprising in combination a set of cards, each imprinted with horizontal and vertical rows of spaces, each space having illustrations of objects that produce a specific sound, a quantity of discs or chips for selectively covering said spaces, and a set of phonograph records each having a collection of sounds recorded thereupon in sequence, said cards each having differentially arranged certain of said illustrations which each said record has a differently arranged certain of said sounds, wherein said game includes a means for checking a players play for correctness, wherein said means comprises a phonograph having a row of spaces thereupon receiving a calibrated scale, identified with names of sounds, and a needle operated by a mechanism of said phonograph traveling across said row of spaces and calibrated scale.

2. A game as in claim 1, wherein said means comprises a scale with indicia mounted on said phonograph coordinated with said phonograph to indicate the sound played corresponding to a specific portion of the record.

* * * * *